US007867041B1

(12) United States Patent
Gardiner

(10) Patent No.: US 7,867,041 B1
(45) Date of Patent: Jan. 11, 2011

(54) SYSTEM AND METHOD FOR A TERMINAL ASSEMBLY

(75) Inventor: Andrew Lee Gardiner, Maine, NY (US)

(73) Assignee: Emerson Electric Co., St. Louis, MO (US)

( * ) Notice: Subject to any disclaimer, the term of this patent is extended or adjusted under 35 U.S.C. 154(b) by 12 days.

(21) Appl. No.: 12/546,021

(22) Filed: Aug. 24, 2009

(51) Int. Cl.
*H01R 9/22* (2006.01)

(52) U.S. Cl. ..... 439/709; 439/814

(58) Field of Classification Search ..... 439/709, 439/721, 722, 723, 810–814
See application file for complete search history.

(56) References Cited

U.S. PATENT DOCUMENTS

| | | | | |
|---|---|---|---|---|
| 3,434,103 | A * | 3/1969 | Hancock et al. | 439/812 |
| 3,452,317 | A * | 6/1969 | Carlson | 439/431 |
| 3,551,876 | A | 12/1970 | Walter | |
| 3,727,171 | A | 4/1973 | Coles et al. | |
| 4,057,312 | A | 11/1977 | Hagermo | |
| 4,603,376 | A | 7/1986 | Maier | |
| 4,629,281 | A * | 12/1986 | Kruger | 439/791 |
| 5,021,014 | A | 6/1991 | Walter et al. | |
| 6,437,268 | B1 * | 8/2002 | Etscheidt et al. | 200/305 |
| 6,663,443 | B1 * | 12/2003 | Smith et al. | 439/811 |
| 7,056,163 | B2 | 6/2006 | Hay | |
| 7,798,869 | B1 * | 9/2010 | Konopacki et al. | 439/812 |
| 2006/0228950 | A1 * | 10/2006 | Jamaleddin et al. | 439/709 |
| 2007/0293096 | A1 * | 12/2007 | Hackemack et al. | 439/709 |

* cited by examiner

*Primary Examiner*—Ross N Gushi
(74) *Attorney, Agent, or Firm*—Locke Lord Bissell & Liddell LLP

(57) ABSTRACT

The present disclosure provides a mounting base, a buss bar with slots and a slotted extension therebetween, and a terminal lug coupled to the buss bar, the terminal lug being adapted to couple directly a conductor to the buss bar at the slotted extension without intermediate interfaces between the conductor and the buss bar. The terminal lug includes a bottom dimensioned to fit on the underside of the slotted extension, and sides dimensioned to fit inside the slots. The terminal lug is restrained from sliding off the slotted extension by being disposed in a lug clearance recess formed in the mounting base that is at a lower elevation than a buss bar support surface. Thus, the system and method provides a direct connection between the conductor and the buss bar, while retaining the terminal lug to the buss bar before the terminal lug is tightened to the buss bar.

18 Claims, 3 Drawing Sheets

SYSTEM AND METHOD FOR A TERMINAL ASSEMBLY

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates to electrical connections. More specifically, the disclosure relates to terminal lugs used for distribution panels, circuit breaker boxes, and other electrical apparatus having an electrical connection to a buss bar.

2. Description of the Related Art

A buss bar is an efficient electrical transition member, often used to connect an incoming wire to one or more outlets. Buss bars are often used in distribution panels, circuit breaker boxes, and other electrical apparatus having one or more electrical connections. The buss bar is typically a flat elongated sheet or bar of a conductive material, such as copper, brass, or aluminum. The wire is typically solid or stranded wire.

A terminal lug is typically used to connect the wire to the buss bar. The terminal lug is shaped with a top, a bottom, and sides, with an opening formed therein for the wire to be placed. A screw is threaded into the top and can be rotated downward into the opening, so that the wire is secured in the opening.

However, the terminal lug is typically bolted to the surface of the buss bar by an intermediate lug extending outward from the terminal lug. Thus, the electrical flow is from the wire, through the lug, and to the buss bar. This typical practice has at least three disadvantages. First, the extra connection through the intermediate lug introduces an additional interface that creates some impedance by its existence. Second, the interface is subject to corrosion and other impurities that can increase the impedance. Third, the bolted connection can become loose and further increase the impedance. An increase in impedance can degrade the system performance to unacceptable levels and create high heat and even failure.

One solution is offered by U.S. Pat. No. 4,603,376 that teaches a direct connection between the buss bar and the wire. The Abstract teaches "A terminal assembly for connecting a line cable to the bus conductor of a circuit interrupter or similar device by means of a locking screw that extends through the top wall of a metal lug component and clamps the inserted ends of the cable and bus conductor in overlapping relationship with each other and positive electrical contact with the bottom wall of the lug component. The bus conductor is held in slip-fitted interlocked position at the bottom of the lug component opening by the coaction of a pair of undercut grooves in the side walls of the lug component that accommodate the side edges of the bus conductor and cooperates with a coupling screw which extends through the bottom wall of the lug component and engages an unthreaded hole in the inserted end of the bus conductor. The lug component is fabricated from a block-like piece of extruded metal or, alternatively, from a piece of strap-like metal stock that is bent into hollow-rectangular form and provided with a pair of inturned arcuate tabs or inwardly protruding circular nibs that provide the same slip-fitting keyed fit with the inserted apertured end of the bus conductor."

However, the configuration of the above patent teaches a coupling screw connection between the lug component and the bus conductor to keep the lug component from slipping off the bus conductor for later use and connections. This extra coupling screw causes extra assembly time and steps in aligning the holes between the lug component and the bus conductor, threading the screw, and tightening the screw to secure the lug component with the bus conductor.

Therefore, there remains a need for a system and method that reduces the impedance created by the typical terminal lug connected with the buss bar and provides a restricted movement of the lug before tightening to the buss bar.

BRIEF SUMMARY OF THE INVENTION

The present disclosure provides a mounting base, a buss bar with slots and a slotted extension therebetween, and a terminal lug coupled to the buss bar. The terminal lug couples directly a conductor, such as a wire, to the buss bar at the slotted extension without intermediate interfaces between the conductor and the buss bar. The terminal lug includes an opening formed between a top, a bottom dimensioned to fit on the underside of the slotted extension, and sides dimensioned to fit inside the slots. The terminal lug further includes a fastener that presses the bottom into contact with the underside and presses a conductor disposed in the opening into contact with the upper side of the slotted extension. The terminal lug is restrained from sliding off the slotted extension by being disposed in a lug clearance recess formed in the mounting base that is at a lower elevation than a buss bar support surface on the mounting base. Thus, the system and method provides a direct connection between the conductor and the buss bar, while retaining the terminal lug to the buss bar before the terminal lug is tightened to the buss bar without additional coupling screws or other fasteners between the terminal lug and the buss bar.

The disclosure provides a terminal assembly, comprising: a mounting base having a buss bar support surface and a lug clearance recess disposed at a different elevation than the buss bar support surface; a buss bar coupled to the mounting base and having a first and second slot with a slotted extension disposed between the slots, the slotted extension having an underside and an upper side distal from the underside; and a terminal lug having a top, a bottom, and sides with an opening formed therebetween, the sides being dimensioned to fit inside the slots and the bottom being dimensioned to fit on the underside of the slotted extension, the terminal lug further comprising a fastener adapted to press the bottom into contact with the underside and adapted to press a conductor disposed in the opening into contact with the upper side of the slotted extension, the terminal lug being restrained from sliding off the buss bar from the slots when the terminal lug is aligned with the lug clearance recess and the buss bar is coupled to the mounting base.

The disclosure also provides a terminal assembly, comprising: a buss bar having a first and a second slot with a slotted extension disposed between the slots; a terminal lug having a top, a bottom, and sides with an opening formed therebetween, the sides being dimensioned to fit inside the slots and the bottom being dimensioned to engage the slotted extension between the slots distally from the top; and a mounting base coupled with the buss bar and having a buss bar support surface and a lug clearance recess disposed at a different elevation than the buss bar support surface, the lug clearance recess adapted to restrain the terminal lug from sliding off the buss bar from the slots when the terminal lug is aligned with the lug clearance recess and the buss bar is coupled to the mounting base.

The disclosure further provides a method of assembling a terminal assembly having a mounting base, a buss bar with slots and a slotted extension disposed between the slots, and a terminal lug having a bottom, top, and sides with a fastener disposed in the top, comprising: sliding the sides of the terminal lug into the slots of the buss bar with the bottom of the terminal lug disposed below the buss bar; aligning the terminal lug into a lug clearance recess, the lug clearance recess being recessed into the mounting base; inserting the terminal lug into the lug clearance recess with the terminal lug slidably coupled to the buss bar; coupling the buss bar to the mounting base; inserting a conductor into the terminal lug above the slotted extension; and tightening the fastener on the terminal lug to pull the bottom into contact with an underside of the slotted extension and to push the conductor into contact with an upper side of the slotted extension.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the invention for which patent protection is sought. Those skilled in the art will appreciate that not all features of a commercial embodiment of the invention are described or shown for the sake of clarity and understanding. Persons of skill in this art will also appreciate that the development of an actual commercial embodiment incorporating aspects of the present disclosures will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the embodiments disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicant has created a mounting base, a buss bar with slots and a slotted extension therebetween, and a terminal lug coupled to the buss bar, the terminal lug being adapted to couple directly a conductor to the buss bar at the slotted extension without intermediate interfaces between the conductor and the buss bar. The terminal lug includes a bottom dimensioned to fit on the underside of the slotted extension, and sides dimensioned to fit inside the slots. The terminal lug is restrained from sliding off the slotted extension by being disposed in a lug clearance recess formed in the mounting base that is at a lower elevation than a buss bar support surface. Thus, the system and method provides a direct connection between the conductor and the buss bar, while retaining the terminal lug to the buss bar before the terminal lug is tightened to the buss bar.

Figure 1:
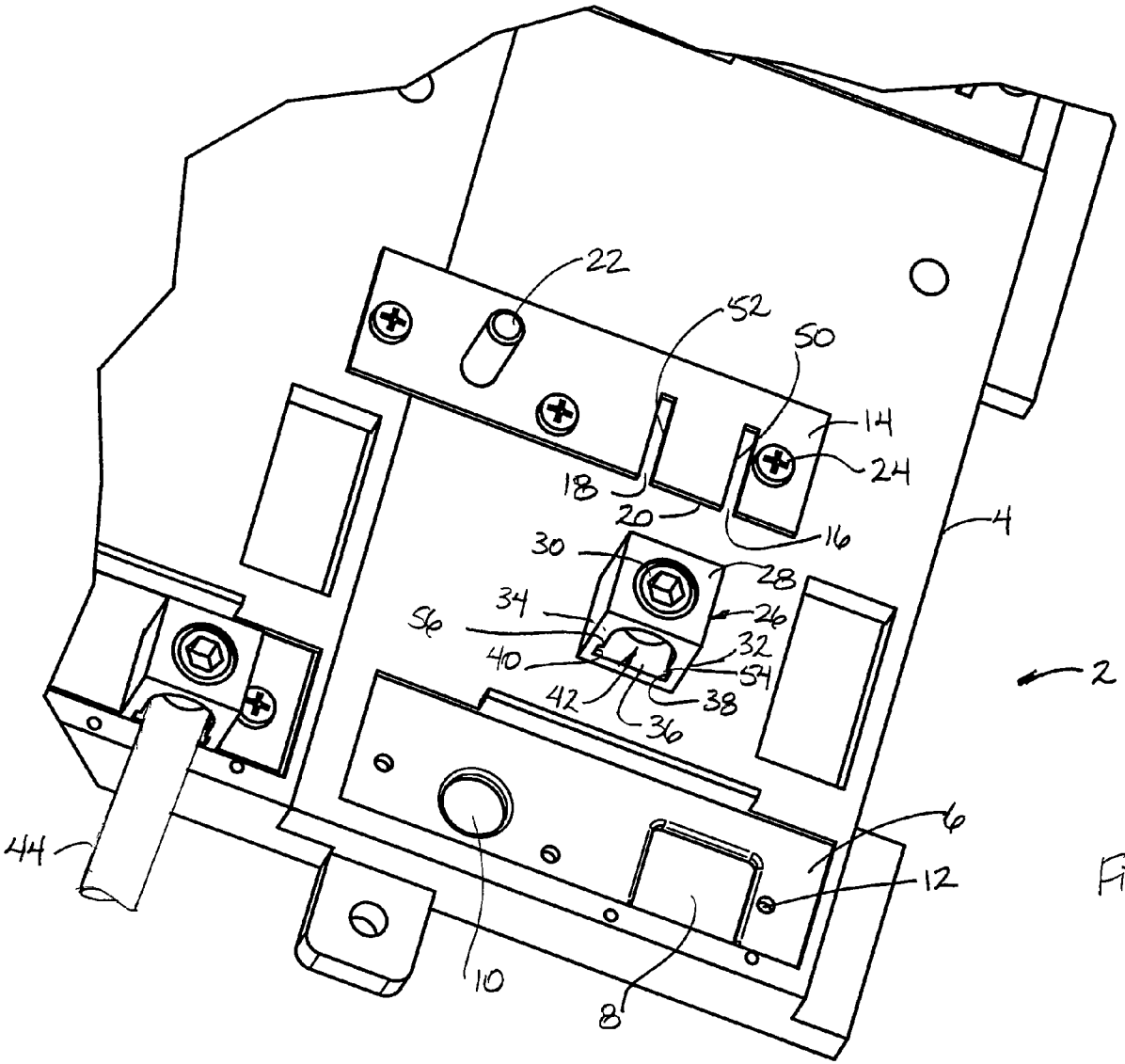
FIG. 1 is a top perspective schematic of a terminal assembly in exploded view.
Figure 2:
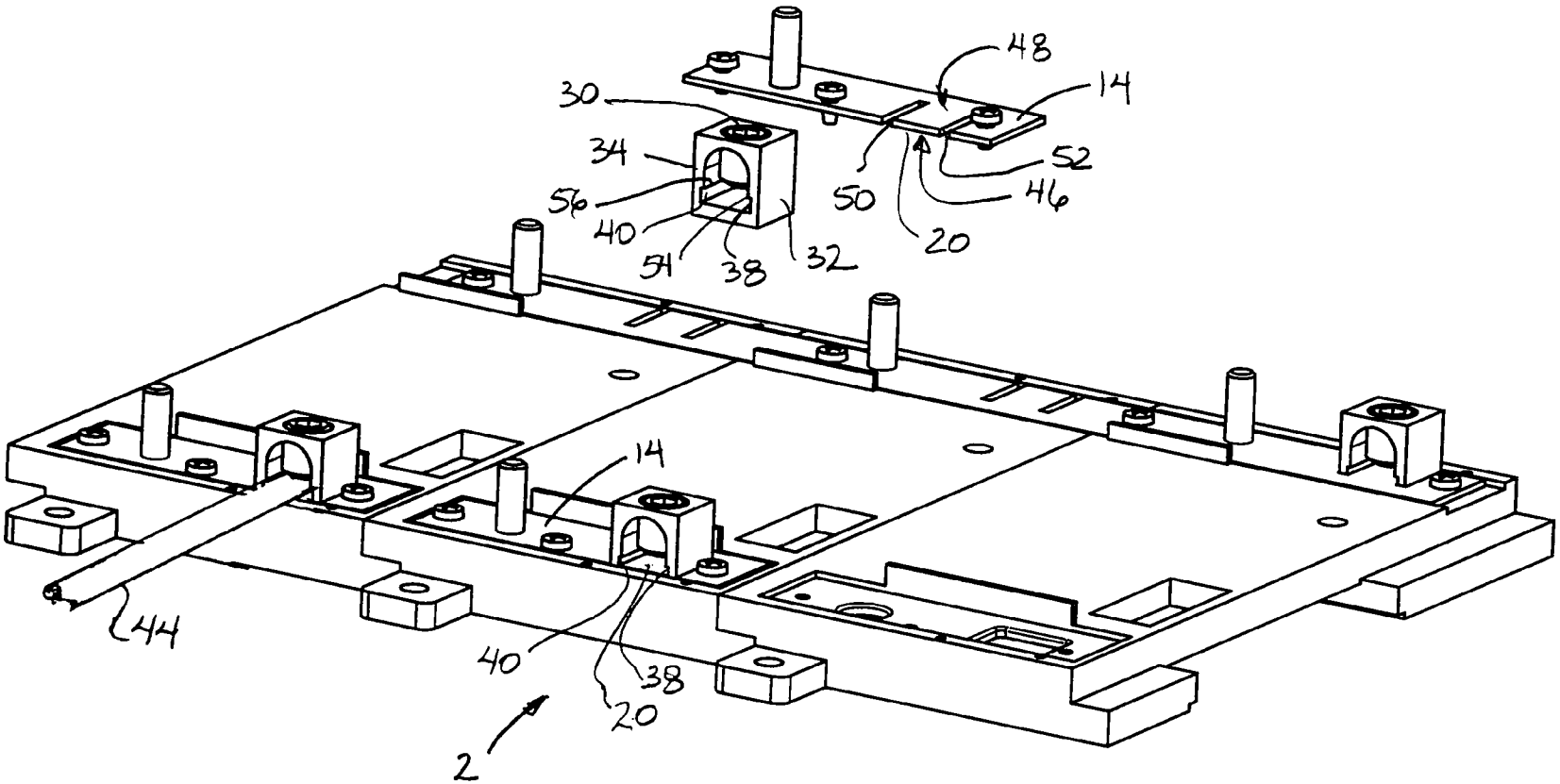
FIG. 2 is a top perspective schematic of the terminal assembly of FIG. 1 in exploded view from a different angle.
Figure 3:
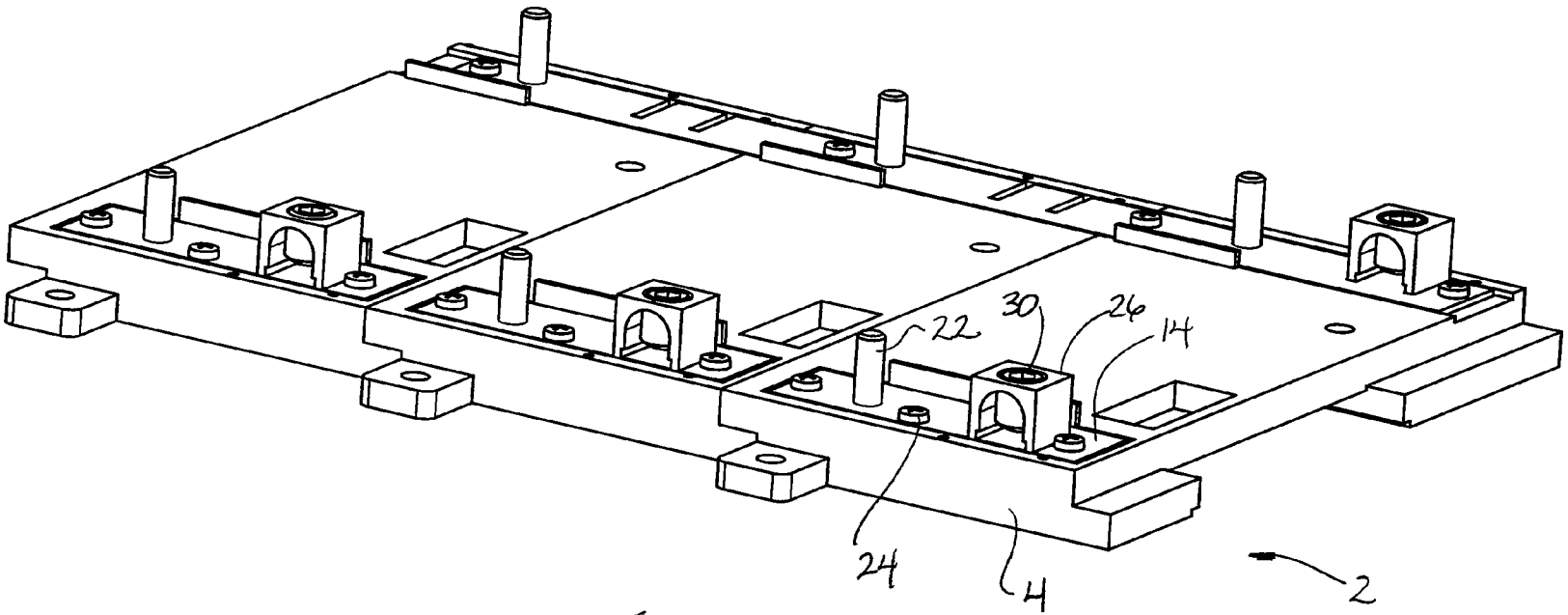
FIG. 3 is a top perspective schematic of the terminal assembly of FIG. 2 in assembled view.

FIG. 1 is a top perspective schematic of a terminal assembly in exploded view. FIG. 2 is a top perspective schematic of the terminal assembly of FIG. 1 in exploded view from a different angle. FIG. 3 is a top perspective schematic of the terminal assembly of FIG. 2 in assembled view. The figures will be described in conjunction with each other.

A terminal assembly 2 generally includes a mounting base 4, a buss bar 14 coupled to the base, and a terminal lug 26 slidably coupled to the buss bar. Taking each component in turn, the mounting base 4 is a structural member that can be coupled with one or more fasteners to a larger structure (not shown), such as a circuit breaker panel, distribution panel, or other electrical assemblies. The mounting base 4 can have one or more buss bar support surfaces 6. In some embodiments, the buss bar support surface 6 can be recessed into the mounting base 4, so that the upper surface of the buss bar 14 is planer with an adjacent upper surface of the mounting base 4. The mounting base 4 can have one or more buss bar support surfaces 6, depending on the requirements of the application. Further, a lug clearance recess 8 can be formed in the mounting base 4. Generally, the lug clearance recess 8 will be formed in the buss bar support surface 6 region. As explained below, the lug clearance recess 8 forms a cavity or a cup in which the terminal lug 26 can be positioned and laterally restrained when the buss bar 14 is coupled to the mounting base 4. Thus, the lug clearance recess 8 will generally be at a different elevation than the buss bar support surface 6. A stud clearance surface 10 can also be formed in the mounting base 4 in the region of the buss bar support surface 6. The stud clearance surface 10 will generally be at a different elevation than the buss bar support surface 6 to allow room for a head of a stud attached to the buss bar 14. One or more fastener receiving surfaces 12 can also be formed in the mounting base 4 to receive one or more fasteners that can securely couple the buss bar 14 to the mounting base 4.

The buss bar 14 is generally a planer member of various geometrical shapes. In at least one embodiment, the buss bar can be a relatively thin, elongated bar, although other shapes are contemplated. The buss bar is made of conductive material, such as copper, aluminum, brass, and other conductive materials. The buss bar can include one or more slots 16, 18 formed through the cross-sectional thickness of the buss bar 14. A slotted extension 20 is formed between the slots 16, 18. The slotted extension 20 forms a surface to couple the terminal lug 26, described below. The slotted extension 20 generally includes a first surface 46, the "underside", that is proximal to the mounting base 4 when the buss bar is mounted to the mounting base. The slotted extension 20 further includes a second surface 48, the "upper side", that is distal from the first surface 46 and the mounting base 4, when the buss bar 14 is mounted to the mounting base. The slots 16, 18 do not extend across the entire surface of the buss bar 14 so that at least a portion of the buss bar can be conductive across its surface, in spite of the presence of the slots 16, 18. A stud 22 can be coupled to the buss bar 14. The stud 22 generally protrudes upward in a perpendicular direction to the upper side of the buss bar 14. The stud 22 can be used to attach various assemblies thereto (not shown, but known to those in the art). One or more fasteners 24, such as screws, can be used to couple the buss bar 14 to the mounting base 4. In the particular embodiment described, the fastener 24 can extend through the buss bar 14 and be threadably coupled to the fastener receiving surface 12.

The terminal lug 26 includes a top 28, sides 32, 34 coupled to the top, and a bottom 36 coupled to the sides. One or more side slots 38, 40 are formed in the sides 32, 34, respectively. The side slots form a ledge 56, 58 in the sides 32, 34, respectively. The slots 38, 40 are dimensioned to slide along the sides 50, 52 of the slotted extension 20. An opening 42 is formed between the top, sides, and bottom of the terminal lug 26. The opening 42 provides a place for a conductor 44, such as wire, to be inserted therein. A fastener 30, such as a threaded Allen screw or other fasteners, engages the top 28 of the terminal lug 26 and can be moved into the opening 42.

In general, the lug clearance recess 8 will be sufficiently sized to allow easy assembly and clearance for the bottom 36 of the terminal lug 26 to be inserted and aligned therein. The lug clearance recess 8 can further be sized so that as the fastener 30 is rotated, the lug clearance recess 8 restricts the rotation of the terminal lug 26 disposed therein. Further, the terminal lug 26 is restrained from sliding off the buss bar 14 from the slots 16, 18 in which the terminal lug 26 is inserted, when the terminal lug 26 is aligned with the lug clearance recess 8 and the buss bar 14 is coupled to the mounting base 4, independent of a separate fastener between the terminal lug and the buss bar.

In assembling the terminal assembly, the terminal lug 26 can be coupled to the buss bar 14 by sliding the sides 32, 34 of the terminal lug into the slots 16, 18 of the buss bar 14. The side slots 38, 40, formed in the sides 32, 34 with their respective ledges 54, 56, can engage a portion of the slotted extension 20 at its sides 50, 52. Thus, the ledges 54, 56 hold the terminal lug 26 in generally an upward position from the perspective shown in the figures before the buss bar 14 is coupled to the mounting base 4. The terminal lug 26 can be aligned to the lug clearance recess 8 and inserted into the lug clearance recess, while the terminal lug is slidably coupled to the buss bar 14. The lug clearance recess 8 can be recessed into the mounting base 4 at a lower elevation than the buss bar support surface 6. The buss bar 14 is coupled to the mounting base 4 while the terminal lug 26 is inserted into the lug clearance recess 8, such as with the fastener 24 engaging the fastener receiving surface 12. If the stud 22 is present, then the stud 22 can also be aligned with the stud clearance surface 10 in a similar manner as the lug clearance recess, prior to coupling the buss bar 14 to the buss bar support surface 6. The conductor 44 can be inserted into the opening 42 of the terminal lug 26 above the slotted extension 20 and below the fastener 30. The fastener 30 can be tightened to accomplish a dual purpose. First, as the fastener is tightened, the bottom 36 of the terminal lug 26 is pulled upward to engage the first surface 46 (underside) of the slotted extension 20. Secondly, and at the same time, the conductor 44 is pushed downward into contact with the second surface 48 (upper side) of the slotted extension 20.

Thus, with minimal assembly and effort, the buss bar 14 and terminal lug 26 can be assembled and placed in the mounting base 4 with the terminal log 26 aligned with the lug clearance recess 8 independent of, and without necessity of, a fastener coupling the terminal lug to the buss bar 14. Further, the direct contact between the conductor 44 and the buss bar 14 through the slotted extension 20 provides for a positive connection independent of other intermediate connections and interfaces common to the art.

Other and further embodiments utilizing one or more aspects of the invention described above can be devised without departing from the spirit of Applicant's invention. For example, the mounting base, buss bar, and terminal lug can be of various shapes and sizes and can be mounted in other orientations besides those depicted in the examples above. Further, the various methods and embodiments of the terminal assembly can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A terminal assembly, comprising:

a mounting base having a buss bar support surface and a lug clearance recess disposed at a different elevation than the buss bar support surface;

a buss bar coupled to the mounting base and having a first and second slot with a slotted extension disposed between the slots, the slotted extension having an underside and an upper side distal from the underside; and a terminal lug having a top, a bottom, and sides with an opening formed therebetween, the sides being dimensioned to fit inside the slots and the bottom being dimensioned to fit on the underside of the slotted extension, the terminal lug further comprising a fastener adapted to press the bottom into contact with the underside and adapted to press a conductor disposed in the opening into contact with the upper side of the slotted extension, the terminal lug being restrained from sliding off the buss bar from the slots when the terminal lug is aligned with the lug clearance recess and the buss bar is coupled to the mounting base.

2. The terminal assembly of claim 1, wherein the buss bar support surface is recessed into the mounting base and the lug clearance recess is recessed at a lower elevation than the buss bar support surface.

3. The terminal assembly of claim 1, wherein the lug clearance recess is adapted to restrict rotation of the terminal lug when a fastener on the terminal lug is rotated.

4. The terminal assembly of claim 1, wherein the sides of the terminal lug comprise a side slot, each side slot having a ledge adapted to engage a portion of the slotted extension adjacent each slot.

5. The terminal assembly of claim 1, wherein the buss bar further comprises a stud extending perpendicular to a surface of the buss bar.

6. The terminal assembly of claim 5, wherein the mounting base further comprises a stud clearance surface recessed into the mounting base.

7. The terminal assembly of claim 1, wherein the mounting base is adapted to receive a plurality of buss bars and terminal lugs, and further comprising a plurality of buss bars and terminal lugs coupled to the mounting base.

8. A terminal assembly, comprising:

a buss bar having a first and a second slot with a slotted extension disposed between the slots;

a terminal lug having a top, a bottom, and sides with an opening formed therebetween, the sides being dimensioned to fit inside the slots and the bottom being dimensioned to engage the slotted extension between the slots distally from the top; and a mounting base coupled with the buss bar and having a buss bar support surface and a lug clearance recess disposed at a different elevation than the buss bar support surface, the lug clearance recess adapted to restrain the terminal lug from sliding off the buss bar from the slots when the terminal lug is aligned with the lug clearance recess and the buss bar is coupled to the mounting base.

9. The terminal assembly of claim 8, wherein the buss bar support surface is recessed into the mounting base and the lug clearance recess is recessed at a lower elevation than the buss bar support surface.

10. The terminal assembly of claim 8, wherein the terminal lug further comprises a fastener adapted to press the bottom into contact with a first surface of the slotted extension and further adapted to press a conductor disposed in the opening into contact with a second surface of the slotted extension distal from the first surface.

11. The terminal assembly of claim 8, wherein the sides of the terminal lug comprise a side slot, each side slot having a ledge adapted to engage a portion of the slotted extension adjacent each slot.

12. The terminal assembly of claim 8, wherein the buss bar further comprises a stud extending perpendicular to a surface of the buss bar.

13. The terminal assembly of claim 12, wherein the mounting base further comprises a stud clearance surface recessed into the mounting base.

14. The terminal assembly of claim 8, wherein the mounting base is adapted to receive a plurality of buss bars and terminal lugs, and further comprising a plurality of buss bars and terminal lugs coupled to the mounting base.

15. The terminal assembly of claim 8, wherein the lug clearance recess is adapted to restrict rotation of the terminal lug when a fastener on the terminal lug is rotated.

16. A method of assembling a terminal assembly having a mounting base, a buss bar with slots and a slotted extension disposed between the slots, and a terminal lug having a bottom, top, and sides with a fastener disposed in the top, comprising:

sliding the sides of the terminal lug into the slots of the buss bar with the bottom of the terminal lug disposed below the buss bar;

aligning the terminal lug into a lug clearance recess, the lug clearance recess being recessed into the mounting base;

inserting the terminal lug into the lug clearance recess with the terminal lug slidably coupled to the buss bar;

coupling the buss bar to the mounting base;

inserting a conductor into the terminal lug above the slotted extension; and tightening the fastener on the terminal lug to pull the bottom into contact with an underside of the slotted extension and to push the conductor into contact with an upper side of the slotted extension.

17. The method of claim 16, further comprising aligning the buss bar with a buss bar support surface formed on the mounting base, prior to coupling the buss bar to the mounting base, the lug clearance recess being recessed at a lower elevation than the buss bar support surface.

18. The method of claim 16, further comprising restricting a rotation of the terminal lug when the terminal lug is inserted into the lug clearance recess.

* * * * *